US005668527A

United States Patent [19]

Lin

[11] Patent Number: 5,668,527

[45] Date of Patent: Sep. 16, 1997

[54] DOORBELL BASE

[76] Inventor: Sheng-Hsiung Lin, 306, Wu Fu Road, Wu Feng Hsiang, Taichung, Taiwan

[21] Appl. No.: 673,316

[22] Filed: Jun. 28, 1996

[51] Int. Cl.[6] ..... G10K 1/26

[52] U.S. Cl. ..... 340/396.1; 340/392.4; 340/393.2

[58] Field of Search ..... 340/392.1, 393.2, 340/392.4, 392.5, 396.1, 328, 692, 384.1, 384.4, 384.7

[56] References Cited

U.S. PATENT DOCUMENTS

| | | | |
|---|---|---|---|
| 2,014,442 | 9/1935 | Miller | 340/396.1 |
| 2,205,189 | 6/1940 | Edwards | 340/396.1 |
| 2,219,036 | 10/1940 | Mason | 340/392.4 |
| 2,245,453 | 6/1941 | Warren | 340/392.4 |
| 2,386,738 | 10/1945 | Corbett | 340/396.1 |
| 2,470,600 | 5/1949 | Bossard | 340/392.5 |

*Primary Examiner*—Jeffery Hofsass
*Assistant Examiner*—Anh La
*Attorney, Agent, or Firm*—Charles E. Baxley, Esq.

[57] ABSTRACT

A doorbell base is made integrally and composed of a receiving frame having a frame plate for fastening a PC board, a plurality of locating protuberances for fastening a plurality of striking devices, a plurality of receiving slots for locating batteries serving as a power source of the PC board, a plurality of locating pieces for locating a plurality of chiming devices, and a plurality of protruded edges having a fastening hole engageable with a fastening screw for fastening the doorbell base with a wall in conjunction with a bracing plate.

1 Claim, 7 Drawing Sheets

DOORBELL BASE

FIELD OF THE INVENTION

The present invention relates generally to a doorbell, and more particularly to an improved base of the doorbell.

BACKGROUND OF THE INVENTION

In general, the conventional doorbell is provided with three chiming tubes, as shown in FIG. 1, or four chiming tubes, as shown in FIG. 2. In other words, the conventional doorbell must be provided with two kinds of PC boards, depending on the number of the chiming tubes that the doorbell has. In addition, the conventional doorbell must be also provided with three or four hanging bases to facilitate the mounting of three or four chiming tubes. As illustrated in FIG. 3, the hanging bases are first fastened with the doorbell base before the striking device is secured to the receiving slot located under the hanging bases. Thereafter, the PC board is fastened with the hanging bases such that the bottom of the PC board is located securely in the recesses of the hanging bases, and that the top of the PC board is fastened with the doorbell base, and further that the PC board is connected with the coil of the striking device. In the case of the doorbell with three chiming tubes, each of three chiming tubes is provided with a chiming plate whose bottom end is received in the tube. The chiming tubes are fastened respectively with a locating piece which is in turn fastened onto the wall. The chiming plate is provided at the top end thereof with a through hole in which a plug is located such that the plug is retained in a U-shaped slot located in the back of the hanging base so as to facilitate the striking of the chiming plate by the striking bar of the striking device. In the case of the doorbell with four chiming tubes the chiming tubes are fastened with a locating board which is provided with a through hole for engaging a hanging plate of the hanging bases so, as to enable the striking bar to strike directly the chiming tubes.

Such a conventional doorbell base as described above is defective in design in that it is rather complicated in construction, and that it is not cost-effective. In addition, the PC boards of different sizes must be used for the doorbell with three chiming tubes and the doorbell with four chiming tubes.

SUMMARY OF THE INVENTION

It is therefore the primary objective of the present invention to provide a doorbell with an improved base which is relatively simple in construction and is therefore cost-effective.

It is another objective of the present invention to provide an improved doorbell base with a PC board which can be used interchangeably with doorbells having three chiming tubes and four chiming tubes.

The foregoing objectives of the present invention are attained by a doorbell base, which is made integrally to provide accommodations for the PC board, the batteries, the striking device, and the chiming device having three or four chiming tubes. The assembly work of the doorbell base can be thus completed on one production line.

The objectives, features, functions and advantages of the present invention will be more readily understood upon a thoughtful deliberation of the following detailed description of a preferred embodiment of the present invention in conjunction with the accompanying drawings.

DETAILED DESCRIPTION OF THE EMBODIMENT

Figure 1:
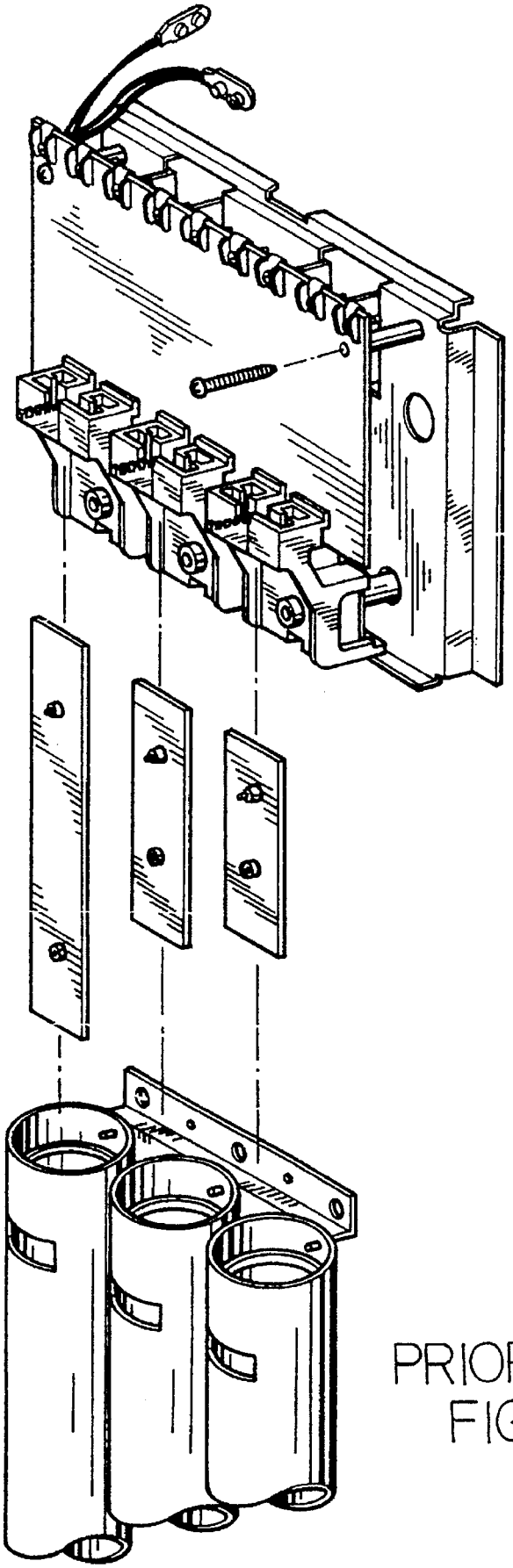
PRIOR ART FIG. 1
FIG. 1 shows a partial exploded view of a doorbell of the prior art.
Figure 2:
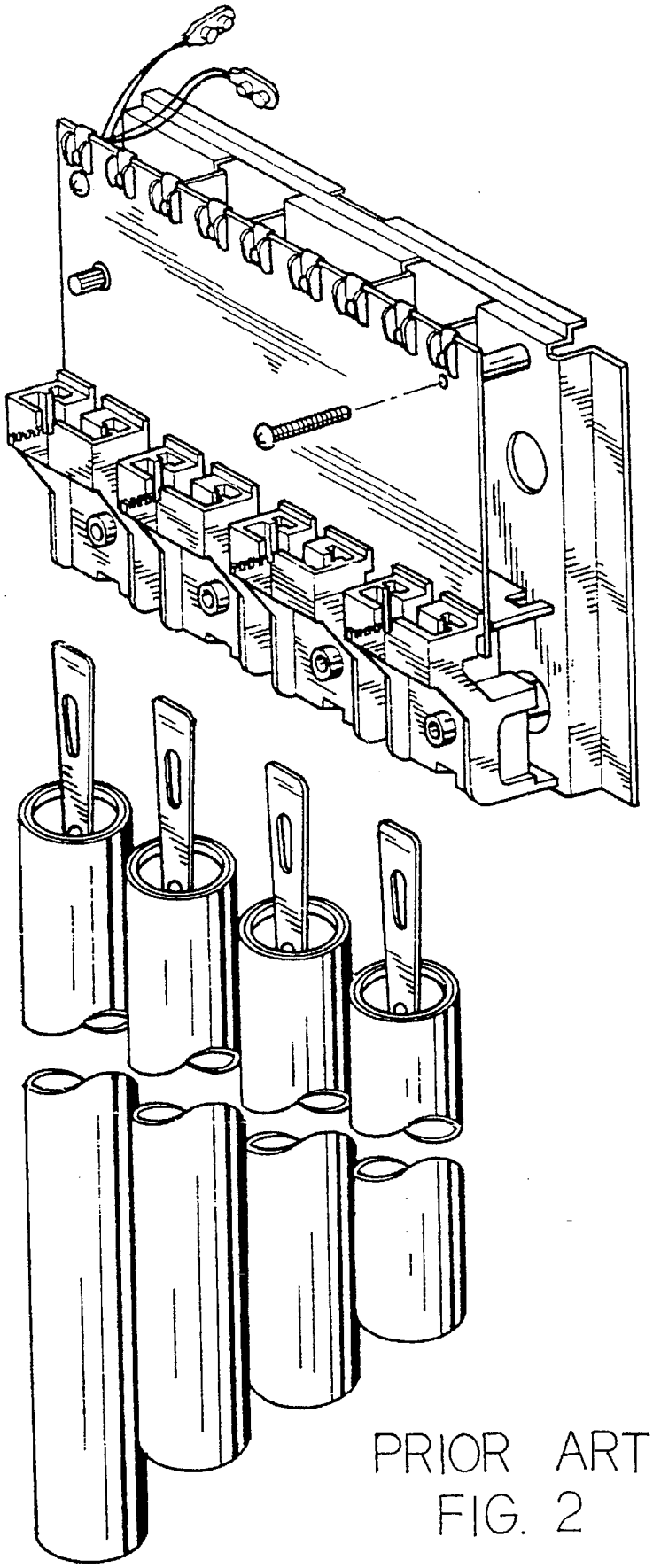
PRIOR ART FIG. 2
FIG. 2 shows another partial exploded view of the doorbell of the prior art.
Figure 3:
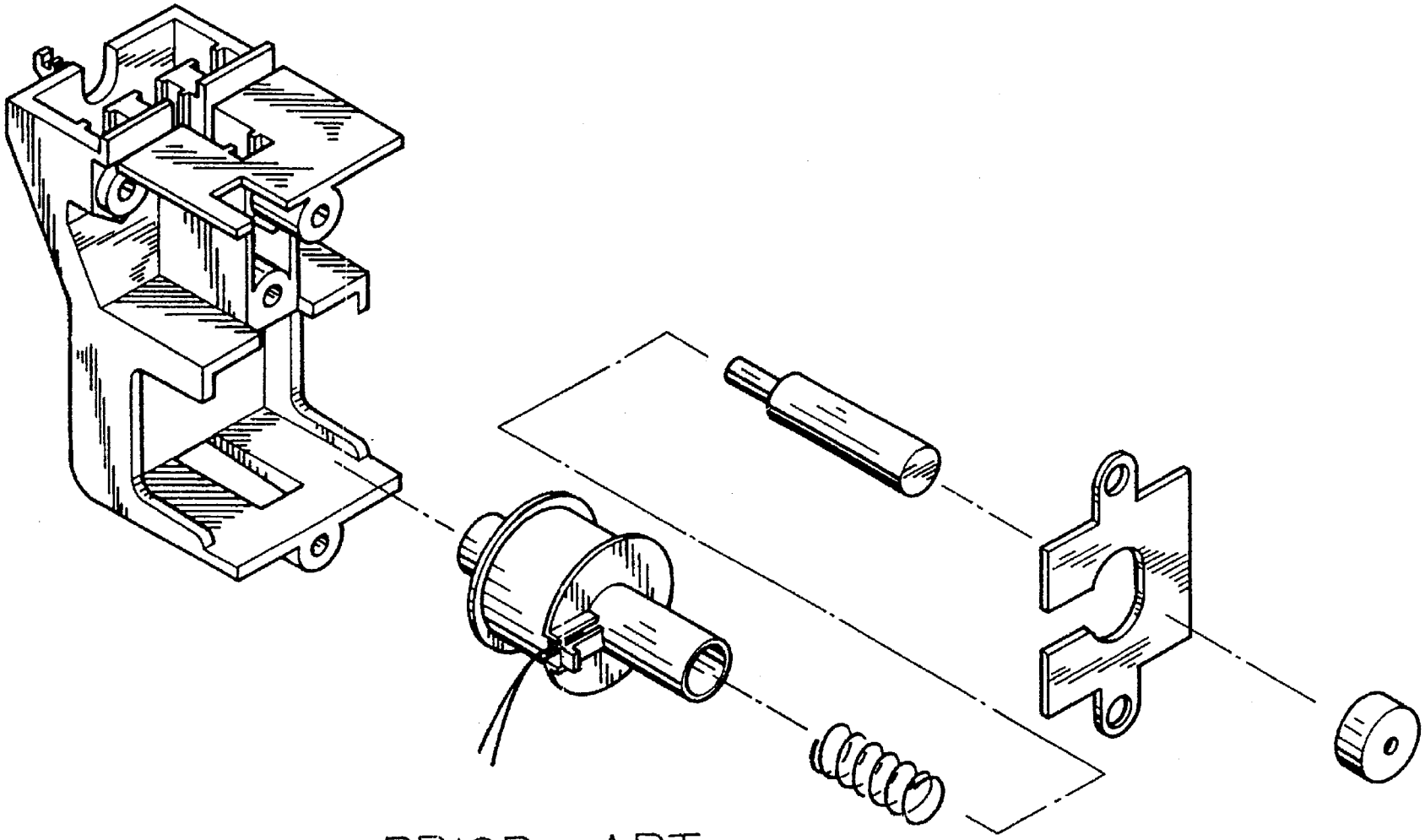
PRIOR ART FIG. 3
FIG. 3 shows an exploded view of a striking device and a hanging base of the doorbell of the prior art.
Figure 4:
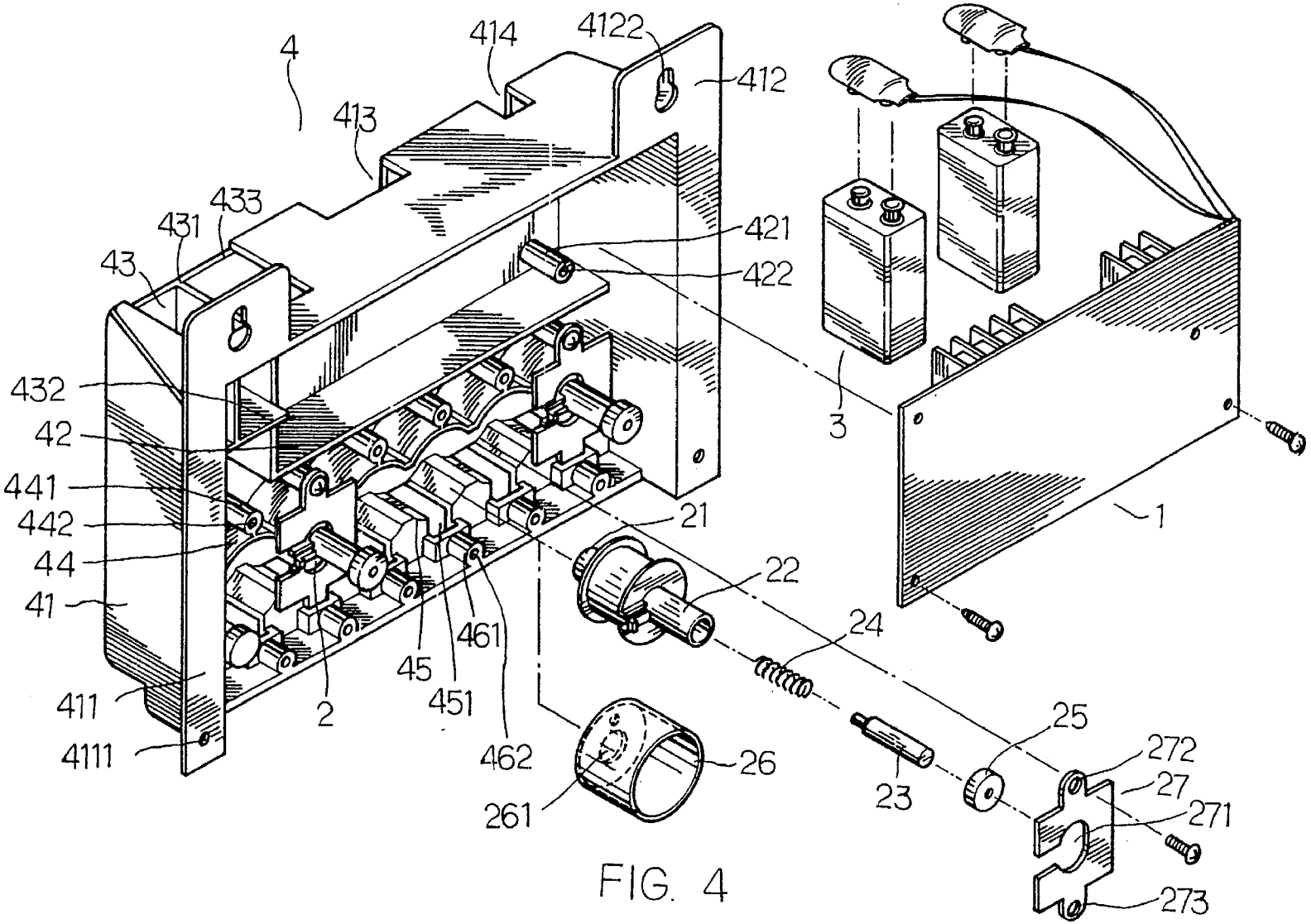
FIG. 4 shows an exploded view of a doorbell of the present invention.

As shown in FIGS. 4–7, a doorbell embodied in the present invention comprises a PC board 1, a plurality of striking devices 2, two batteries 3, a base 4, a plurality of chiming devices, 51, 52, 53 and a bracing plate 6.

The PC board 1 is provided with a control loop which can be switched interchangeably for use in the chiming devices 51, 52, 53 having three or four chiming robes.

The striking devices 2 have a midsegment fired into a coil, and two tubular bodies 21 and 22 which extend respectively from both ends of the midsegment. The tubular body 22 is of a hollow construction and is provided with a striking bar 23 which is fitted into the hollow interior of the tubular body 22 along with a spring 24 which is fitted over one end of the striking bar 23. The tubular body 22 is fastened at the free end thereof with a fitting body 25. Each striking device 2 is fitted into an outer cover 26 such that the tubular body 21 is jutted out of a through hole 261 of the outer cover 26. The tubular body 22 is retained in a holding hole 271 of a holding piece 27. The holding piece 27 has two locating holes 272 and 273 which are opposite in location to each other.

Figure 5:
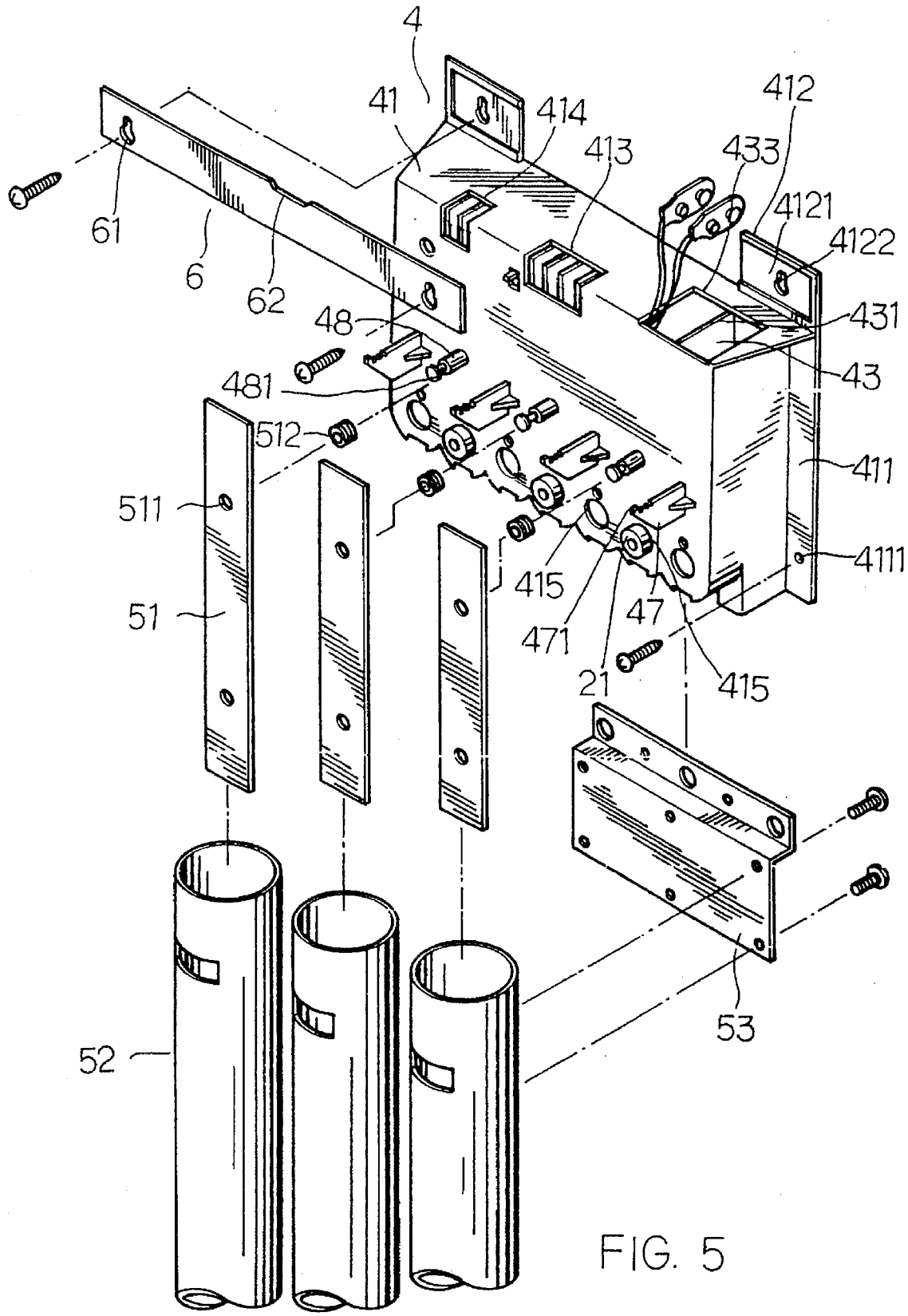
FIG. 5. shows another exploded view of the doorbell of the present invention.
Figure 6:
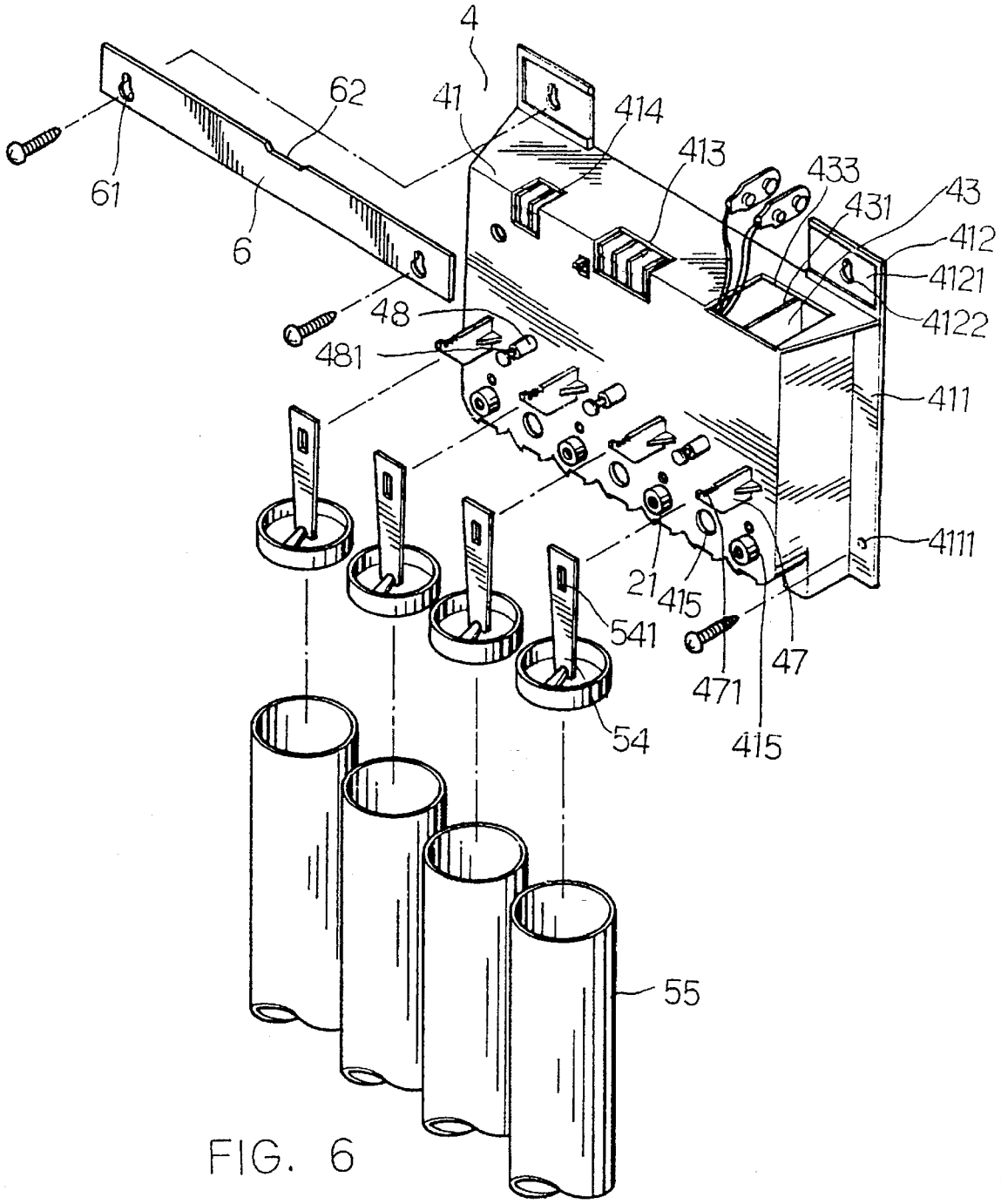
FIG. 6. shows still another exploded view of the doorbell of the present invention
Figure 7:
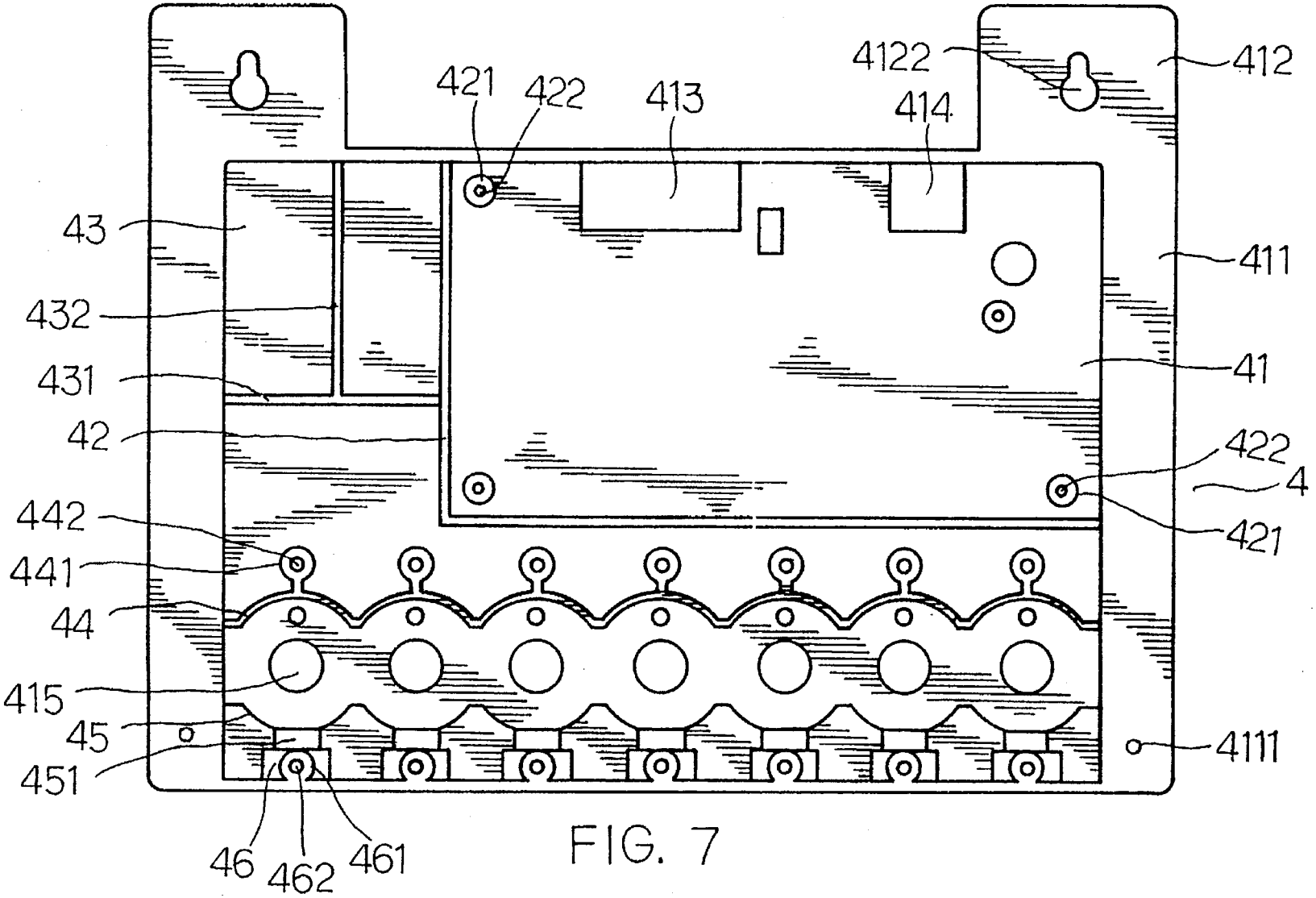
FIG. 7 shows a front schematic view of a base of the doorbell of the present invention.

The base 4 is made integrally and composed of a receiving frame 41 having two protruded edges 411 which are provided respectively with a locating hole 4111. The protruded edges 411 has a protruded block 412 opposite in location to the locating hole 4111. The protruded block 412 is provided in the periphery thereof with a groove 4121, and at the center thereof with a through hole 4122. The receiving frame 41 is provided in the upper portion thereof with an L-shaped frame plate 42. Located between one side wall of the receiving frame 41 and the frame plate 42 is a locating pillar 421 which has axially a threaded hole 422. The receiving frame 41 is provided in one side thereof with two frame slots 413 and 414. Two receiving slots 43 are formed jointly by the frame plate 42, a longitudinal partition 431 and a horizontal partition 432. Located under the frame plate 42 of the receiving frame 41 are a plurality of arcuate plates 44 which are connected with one another and are provided respectively at the top thereof with a projection 441 having axially a threaded hole 442. The receiving frame 41 is further provided with a plurality of arcuate bodies 45 which are slotted and located under the arcuate plates 44. The arcuate bodies 45 are provided respectively at the bottom end thereof with a hole 451 provided with a locating body 46. The locating body 46 is provided in one side thereof with a columnar body 461 having axially a threaded hole 462. The receiving frame 41 is further provided in the bottom thereof with a plurality of round through holes 415 which are separated equidistantly such that they are corresponding in location to the arcuate bodies 45, as shown in FIGS. 5 and 6. The receiving frame 41 is still further provided with a plurality of hanging plates 47 which are located over the round through holes 415 and are provided respectively at the top thereof with a toothed portion 471. The receiving frame 41 is still further provided with a plurality of locating protuberances 48 having at a free end thereof a diminishing portion 481.

As shown in FIG. 5, the chiming device 51, 52, 53 comprises three chiming plates 51 which are received respectively at the bottom end thereof in the chiming robes 52 which are fastened respectively with a locating piece 53. The locating piece 53 is fastened with the locating body 46 of the base 4. The chiming plate 51 has a through hole 511 in which a plug 512 is received.

As shown in FIG. 6, the chiming device 51, 52, 53 comprises four chiming tubes 55 which are fastened respectively with a locating plate 54 having a rectangular through hole 541 engageable with the toothed portion 471 of the hanging plate 47.

The bracing plate 6 has two fastening holes 61 and a recessed edge 62. The bracing plate 6 is fastened with the receiving frame 41 such that the bracing plate 6 can be fastened on a wall by means of screws engaging the fastening holes 61 of the bracing plate 6 and the through holes 4122 of the protruded blocks 412 of the receiving frame 41 of the base 4. The receiving frame 41 is fastened with the wall by means of screws engaging the locating holes 4111 of the receiving frame 41.

The PC board 1 is fastened with the base 4 by means of screws engageable with the threaded holes 422 of the locating pillars 421 of the base 4. The batteries 3 are received in the receiving slots 43 the base 4. The striking devices 2 are fastened with the arcuate bodies 45 of the base 4 such that the tubular bodies 21 are jutted out of the round through holes 415 of the receiving frame 41 of the base 4, and that the holding bodies 27 of the striking devices 2 are located by the locating bodies 46 of the base 4. The locating bodies 46 are in turn located by the arcuate plates 44 by means of screws engaging the through holes 272 of the holding bodies 27 and the threaded holes 442 of the projections 441 of the arcuate plates 44. The frame slots 413 and 414 of the receiving frame 41 of the base 4 are intended for use in arranging the wires and the switches of the power source for the PC board 1.

The chiming tubes of the chiming devices 51, 52, 53 ring out when struck by the striking bars 23 of the striking devices 2 at the time when the PC board 1 is activated to cause the coils of the striking devices 2 to bring about the magnetic field repulsion.

The doorbell of the present invention is characterized in that it comprises the base 4 which is made integrally so as to enable the assembly work of the doorbell to be completed with ease and speed. In addition, the base 4 is provided with a plurality of arcuate bodies 45 to facilitate the mounting of three or four striking devices 2 in conjunction with three or four chiming robes of the chiming devices 51, 52, 53. Moreover, the doorbell of the present invention is provided with the PC board 1 which is compatible with the chiming devices 51, 52, 53 having three or four chiming robes.

What is claimed is:

1. A doorbell comprising:

a base including a receiving frame, said receiving frame including an L-shaped frame plate and including a plurality of locating protuberances each having a diminishing free end portion, said receiving frame including at least one receiving slot and including a plurality of locating pieces, said receiving frame including at least two protruded edges each having a fastening hole for engaging with a fastening member and for allowing the protruded edges to be fastened to a wall, said protruded edges each including a protruded block having a groove, and said receiving frame including a plurality of hanging plates each having a toothed portion formed on top;

a processor controller (PC) board fastened with said frame plate of said receiving frame of said base;

a plurality of striking devices fastened with said locating protuberances of said receiving frame of said base, said striking devices each including a midsegment, said midsegments each including two ends each having a tubular body extended outward, a first of said tubular bodies including a hollow construction for receiving a striking bar and a spring;

at least one battery located in said receiving slot of said receiving frame of said base for serving as a power source of said PC board;

a plurality of chiming devices fastened with said locating pieces of said receiving frame of said base for allowing said chiming devices to ring out when struck by said striking devices, said chiming devices each including a chiming tube secured to said locating piece and each including a plug engaged on said diminishing free end portion of said locating protuberance and each including a chiming plate secured to said plug and said locating protuberance, said chiming plates each including a bottom end received in said chiming tube, a bracing plate engaged in said grooves of said protruded blocks and secured to said protruded blocks for fastening said base to the wall;

said L-shaped frame plate and said locating protuberances and locating pieces and said protruded edges and said protruded blocks and said hanging plates of said receiving frame being made integrally for facilitating assembling of said doorbell.

* * * * *